United States Patent [19]

Maier et al.

[11] Patent Number: 5,022,816

[45] Date of Patent: Jun. 11, 1991

[54] GAS TURBINE BLADE SHROUD SUPPORT

[75] Inventors: Mark S. Maier, North Palm Beach; Jack W. Wilson, Jr., West Palm Beach, both of Fla.

[73] Assignee: United Technologies Corporation, Hartford, Conn.

[21] Appl. No.: 427,226

[22] Filed: Oct. 24, 1989

[51] Int. Cl.[5] ..... F04D 29/40

[52] U.S. Cl. ..... 415/115; 415/182.1

[58] Field of Search ..... 415/115, 116, 182.1, 415/214.1

[56] References Cited

U.S. PATENT DOCUMENTS 2,858,104 10/1958 Kelk et al. ..... 415/190

3,085,398 4/1963 Ingleson ..... 60/39.32

3,990,807 11/1976 Sifford ..... 415/115

3,992,126 11/1976 Brown et al. ..... 415/115

4,566,851 1/1986 Comeau et al. ..... 415/115

4,627,233 12/1986 Baran, Jr. ..... 415/115

*Primary Examiner*—John T. Kwon

*Attorney, Agent, or Firm*—Edward L. Kochey, Jr.

[57] ABSTRACT

Tip shroud segments (26) are supported in support ring (24). The ring has at its downstream end conical surface (32) mating and in interference fit with conical surface (16). When flange (20) is torqued, face (22) aligns and forces support ring (24) into the interference fit. Concentricity and rigidity of the shroud support is obtained in a structure easily assembled and disassembled.

8 Claims, 2 Drawing Sheets

GAS TURBINE BLADE SHROUD SUPPORT

The Government has rights in this invention pursuant to a contract awarded by the Department of the Air Force.

DESCRIPTION

1. Technical Field

The invention relates to gas turbine engines and in particular to the support of static shrouds which surround the rotating blades of the turbine.

2. Background of the Invention

A clearance necessarily exists between the rotating blade of the turbine and the shroud which surrounds the blades and restricts the gas flow bypassing the blades. It is important for operating efficiency of the turbine to minimize this clearance. Excess clearance results in leakage which bypasses the blades. Too little clearance, however, results in rubbing of the blades and damage.

The shroud must be held not only in close proximity to the blades, but must be maintained concentric therewith to avoid varying clearances around the circumference.

Thermal expansion and deflection of various components create difficulty in maintaining appropriate clearance at all times. The use of low coefficient of expansion alloys to support the shrouds improves the blade tip clearance control. This support structure, however, must be in turn supported from the casing which is conventionally of a higher coefficient of expansion material. A shrink fit of this support structure within the casing has been used in the past. This, however, has been located on the casing at a point where internal pressure tends to deflect the casing outward thereby leading toward operating looseness of the fit, and thereby requiring an even tighter fit. The fit selected had to be sufficient to tolerate the differential expansion of the high coefficient of expansion casing and the low coefficient of expansion support structure in addition to this deflection. This has created significant difficulties in assembling the apparatus usually requiring heating of the case for a shrink fit. Disassembly has been even more difficult because of the difficulty of withdrawing the cylindrical interference fit members.

SUMMARY OF THE INVENTION

Two abutting cylindrical turbine casing sections have abutting flanges, with the flange of the downstream section extending inwardly of the flange of the upstream section. The upstream section has a conical surface at its downstream end. A support ring of relatively low coefficient of expansion material as compared to that of the casing is of cylindrical axially extending form and has a conical outside surface at the downstream end, and a ring abutment surface facing downstream at the downstream end. When the flanges are brought into contact with the bolts, the inwardly extending portion of the flange on the downstream section abuts the ring abutment surface forcing the conical surface of the support ring against the conical surface of the upstream casing section. These are sized to provide an interference fit.

The support ring carries at its upstream end a plurality of tip shrouds which are located adjacent to the rotating blades. An outwardly extending flange at this upstream location stiffens the upstream portion of the support ring. A conical tapered leg of the support ring extends from the downstream conical surface toward the upstream portion to accept deflection without disturbing the support of the tip shrouds. A radially extending step between the upstream portion of the support ring and the leg further stiffens the support of the tip shrouds while permitting strain of the downstream conical surface.

The conical surface is a taper angle of about 30 degrees, this being sufficient to establish the necessary strain while bolting the flanges, but being a nonlocking taper angle to facilitate disassembly of the apparatus.

DESCRIPTION OF THE PREFERRED EMBODIMENT

Figure 1:
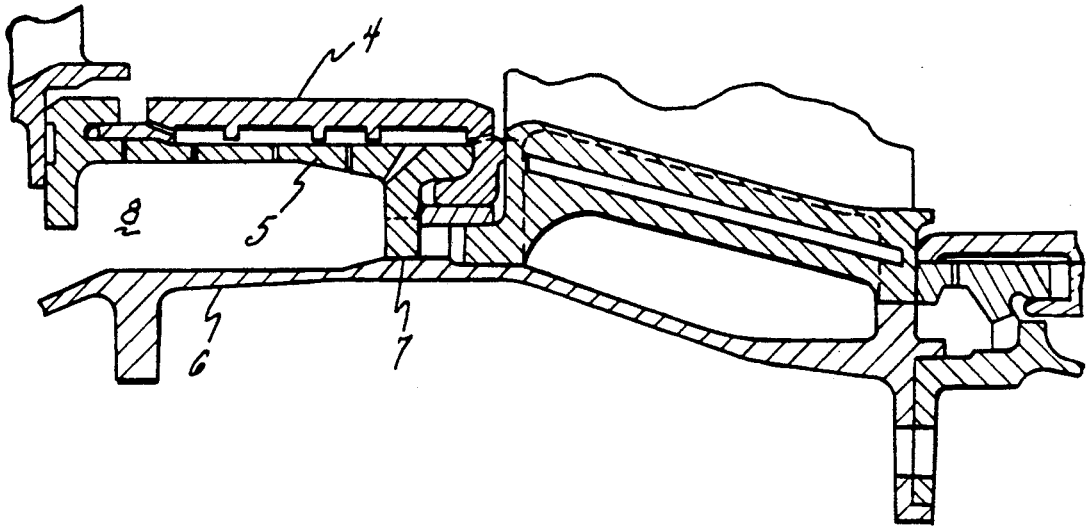
FIG.1 PRIOR ART
FIG. 1 is a prior art shroud support arrangement.

FIG. 1 illustrates a prior art arrangement where the blade shroud ring is formed of a plurality of shroud segments 4 supported within a first stage support ring 5. This support ring is of low coefficient of expansion material. The support ring is supported within casing 6 by a shrink fit at mating cylindrical surfaces 7.

During operation, pressure within chamber 8 tends to deflect the casing outwardly. Differential expansion between the support ring 5 and the casing 6, which is of a relatively high coefficient of expansion material, tends to loosen the shrink fit, as does the outward deflection of the casing. It has been extremely difficult to establish this shrink fit, usually requiring heating of the casing for assembly. Disassembly has become even more difficult requiring large expensive equipment.

Figure 2:
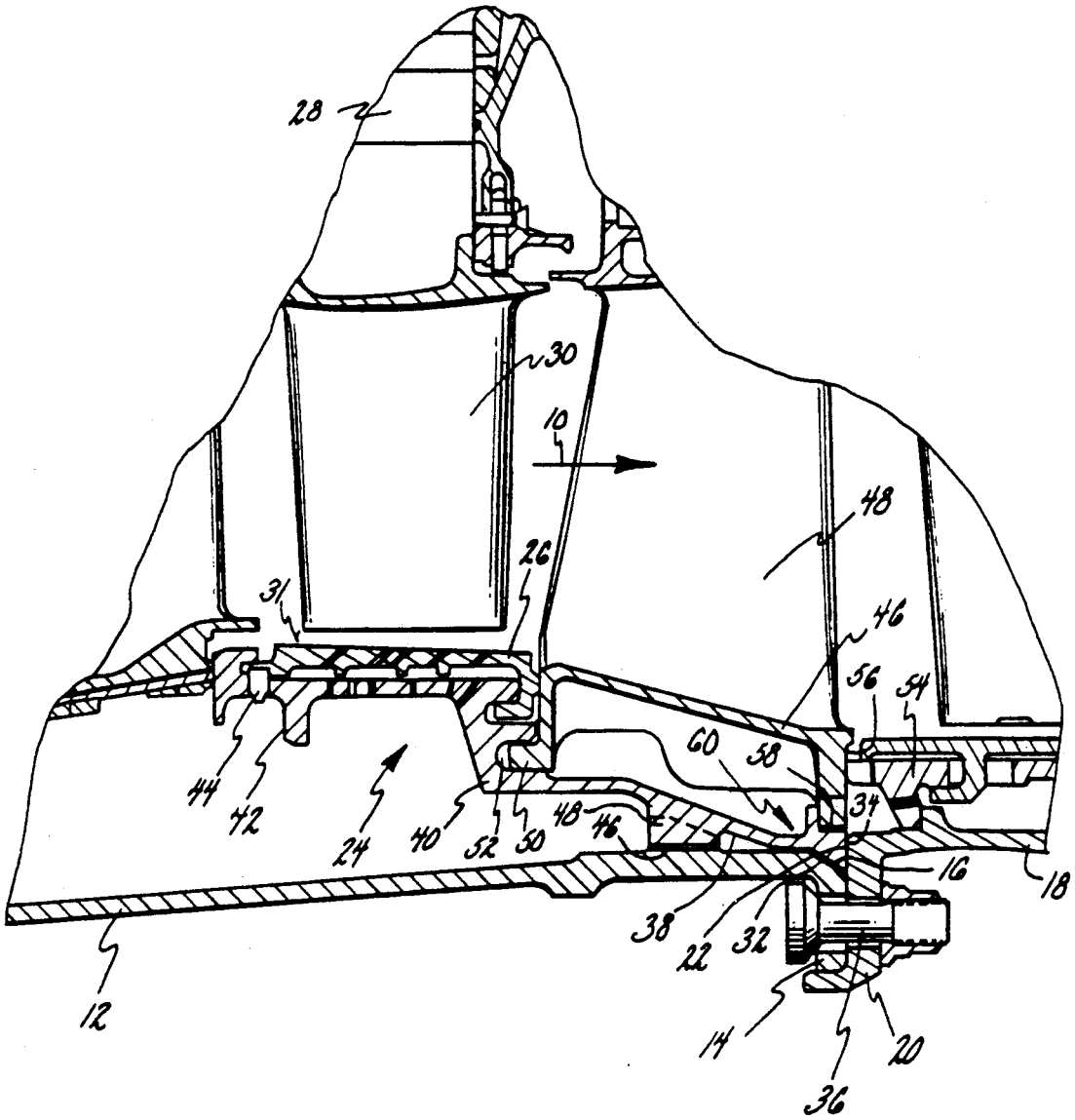
FIG. 2 is sectional side elevation through a portion of the gas turbine showing the shroud support.

Referring to FIG. 2 where the invention is illustrated, there is a gas flow 10 from upstream to downstream within the gas turbine. The cylindrical casing 12 has an outwardly extending flange 14 at its downstream end. There is also a conical outside surface 16 on the upstream section at the location of this flange. A downstream casing 18 has an outwardly extending flange 20 with a portion 22 extending inwardly of flange 14.

First stage support ring 24 carries a plurality of tip shroud segments 26. This support ring is of relatively low coefficient of expansion material relative to the casing as well as to the inner structure including disks 28 of the rotating portion of the turbine. While the turbine blades 30 become extremely hot in operation, the disks are relatively cooled. Accordingly, the overall expansion at the tip of the blades is somewhat limited. If the support ring 24 were of a high coefficient of expansion material, clearance 31 would increase excessively.

At the downstream end of the support ring there is a conical outside surface 32 having the same taper as conical surface 16. The downstream edge of the support ring has a ring abutment surface 34 which abuts the face 22 of flange 20 when bolts 36 are fully torqued. This forces the tapered portion of the support ring into interference fit relationship with casing 12. The flange 14 stiffens the casing at this point so that substantially all the strain is taken within the support ring.

The taper of these two conical surfaces 34 and 32 are preferably 30 degrees with respect to the axis of the turbine, but within a range of 25 to 35 degrees. This avoids the locking taper relationship which would create problems when disassembling. With this range of angles, removing the bolts permits the support ring to easily slide out of the casing. Too steep an angle would increase the force on the bolts required to make up the joint.

Adjacent to the conical outside surface of the support ring, there is tapered leg 38 of between 5 and 25 degrees from the axis of the turbine. This provides sufficient radial force to deter buckling of the lower portion of the support ring and sufficient horizontal length to permit the strain to be absorbed before the location of the shroud support portion of the ring.

A step 40 in the ring further stiffens the critical portion where the tip shrouds are supported, to minimize its deflection caused by the strain of the interference fit. There further is an outwardly extending flange 42 on the support ring coextensive with a portion of the shroud segment which further stiffens the ring at the support location. Pins 44 may be located to prevent rotation of the tip shroud segments 26 with respect to the support ring 24. Also a plurality of inwardly extending lugs 46 on the casing interact with the plurality of outwardly extending lugs 48 on the support ring to prevent rotation of the support ring with respect to the casing.

Vane platform 46 carries a plurality of vanes 48, this platform being concentrically located by leg 50 extending within slot 52 of the support ring 24. Abutment ring 54 located on the downstream casing section abuts the downstream facing surface 56 of the vane platform to maintain its axial position. Clearance is retained at location 58 between the support ring 24 and the vane platform, even with the lower portion of the support ring compressed to its interference fit position.

Figure 3:
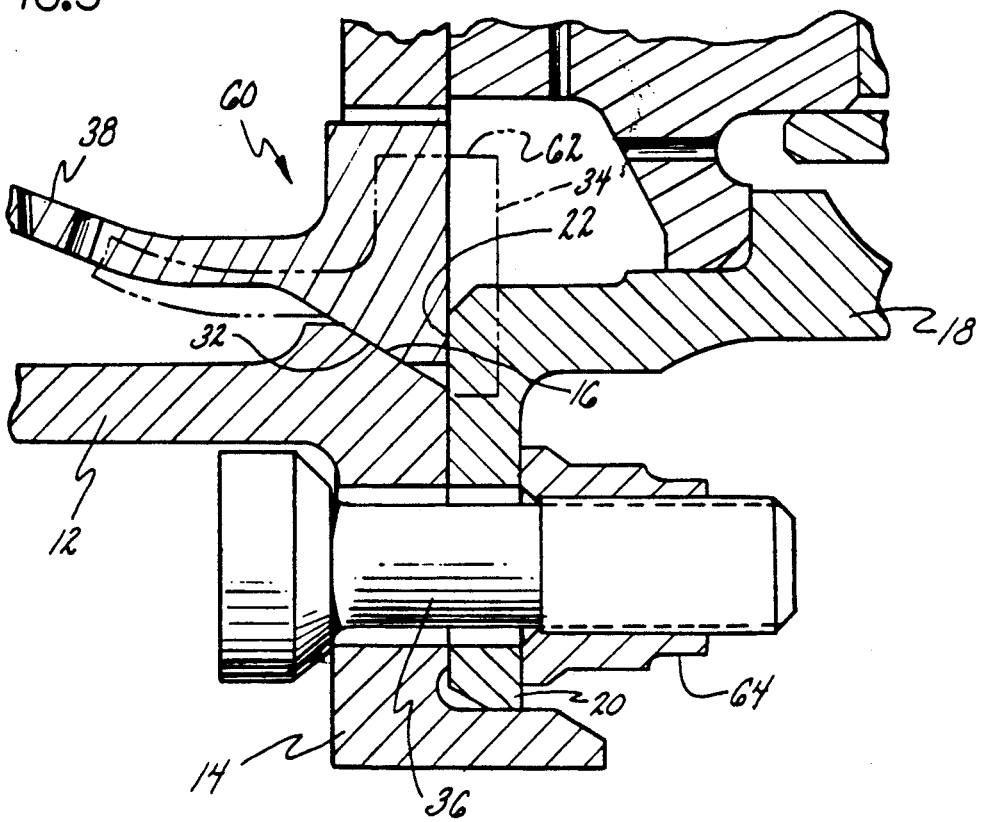
FIG. 3 is a sectional side elevation showing in more detail the conical surface portion in both the deflected and undeflected positions.

FIG. 3 illustrates the downstream portion 60 of the support ring in both its uncompressed and interference fit location. The dotted lines 62 illustrate the position of the portion 60 when initial contact is made and before the bolts are torqued. The conical outside surface 32 of support ring 24 is in contact with the conical inside surface 16 of the casing.

As the bolts 36 are made up by tightening nuts 64, the abutment surface 22 of the flange operating against the downstream facing ring abutment surface 34 forces the support ring into interference contact. The desirable interference is between 0.2 and 0.4 percent and the illustrative design is 0.3 percent which is 0.089 inches on a diameter of 26.15 inches. The abutment between surfaces 22 and 34 together with the considerable force applied thereto operates to maintain the support ring clearly perpendicular to these surfaces and therefore accurately coaxial and concentric with the axis of the gas turbine.

The casing being stiffened at the flange at the location of the interference fit has insignificant deflection either because of internal pressure or because of the interference fit at this location. Accordingly, the interference fit need not be increased because of such deflections.

The portion of the support ring which actually supports the shroud segments is stiffened and removed from the interference fit location where the support ring inherently must be strained. This fit may be assembled and disassembled without the use of large and expensive tools as required by other fits. The arrangement not only uses the radial interference fit to maintain a rigid construction, but also uses the axially facing abutment surfaces to maintain concentricity of the support ring and accordingly the concentricity of the tip shroud segments with respect to the turbine rotor.

What is claimed is:

1. In a gas turbine having an axial flow of gas from upstream to downstream therethrough, a static structure comprising:

a substantially cylindrical upstream casing section of relatively high coefficient of expansion material;

a substantially cylindrical turbine downstream casing section;

a first outwardly extending flange on said upstream section;

a second outwardly extending flange on said downstream section, abutable with said first flange and having a flange abutment surface extending inwardly of said first flange;

a conical inside surface on said upstream section at the location of said first flange;

a plurality of bolts for rigidly joining said first and second flanges;

a first stage support ring of relatively low coefficient of expansion material of substantially cylindrical axially extending form, and having a conical outside surface adjacent the downstream end, with a ring abutment surface at the downstream end, a plurality of tip shrouds carried on said support ring at an upstream support location; and said conical inside surface and said conical outside surface having mating tapers and in touching contact when said support ring is displaced slightly downstream of said upstream casing section, but an interference fit compressive contact when said first and second flanges are in contact and said flange abutment surface is in contact with said ring abutment surface.

2. A static structure as in claim 1:

said conical surfaces having an angle between 25 and 35 degrees with respect to the axis of said turbine.

3. A static support structure as in claim 1:

said interference fit being between 0.2 percent and 0.4 percent.

4. A support structure as in claim 1:

said support ring having an outwardly extending circumferential flange at an upstream location coextensive with the portion of said tip shrouds.

5. A static support structure as in claim 4:

said support ring having a conical leg between said flange and said conical outside surface at an angle between 5 and 25 degrees with respect to the axis of said turbine.

6. A static support structure as in claim 1:

a substantially radial step in said support ring between said upstream location and said conical outside surface; and a conical leg between said radial step and said conical surface.

7. A static support structure as in claim 6:

said conical surface being at an angle of between 25 and 35 degrees with respect to the axis of said turbine; and said conical leg being at an angle of between 5 and 25 degrees with respect to the axis of said turbine.

8. A static support structure as in claim 1:

a plurality of outwardly extending antirotation lugs on said support ring; and a plurality of inwardly extending antirotation lugs on said casing in circumferentially abutable relationship with said outwardly extending antirotation lugs.

* * * * *